US007828059B2

(12) United States Patent
Reid et al.

(10) Patent No.: US 7,828,059 B2
(45) Date of Patent: Nov. 9, 2010

(54) DUAL ZONE FLOW CHOKE FOR DOWNHOLE MOTORS

(75) Inventors: Leslie Claud Reid, Coweta, OK (US); Patricia Diane Dougherty, Bixby, OK (US)

(73) Assignee: Baker Hughes Incorporated, Houston, TX (US)

( * ) Notice: Subject to any disclaimer, the term of this patent is extended or adjusted under 35 U.S.C. 154(b) by 272 days.

(21) Appl. No.: 11/838,678

(22) Filed: Aug. 14, 2007

(65) Prior Publication Data

US 2009/0047157 A1 Feb. 19, 2009

(51) Int. Cl.
*E21B 43/12* (2006.01)

(52) U.S. Cl. ..... 166/250.15; 166/369; 166/373; 166/316; 166/105.5

(58) Field of Classification Search ..... 166/250.15, 166/373, 105.5, 369, 106, 188, 250.01, 387, 166/66, 183, 316
See application file for complete search history.

(56) References Cited

U.S. PATENT DOCUMENTS 5,404,946 A * 4/1995 Hess ..... 166/187
6,138,758 A * 10/2000 Shaw et al. ..... 166/265
6,615,926 B2 * 9/2003 Hester et al. ..... 166/188
6,668,925 B2 * 12/2003 Shaw et al. ..... 166/265
7,055,595 B2 6/2006 Mack et al.
7,322,410 B2 * 1/2008 Vinegar et al. ..... 166/250.15
2001/0037881 A1 * 11/2001 Brecheisen ..... 166/106
2005/0110655 A1 * 5/2005 Layton ..... 340/854.9
2005/0217860 A1 * 10/2005 Mack et al. ..... 166/369
2008/0236821 A1 * 10/2008 Fielder ..... 166/265
2009/0050312 A1 * 2/2009 Zupanick ..... 166/105.5

* cited by examiner

*Primary Examiner*—William P Neuder
*Assistant Examiner*—Elizabeth C Gottlieb
(74) *Attorney, Agent, or Firm*—Bracewell & Giuliani LLP

(57) ABSTRACT

A submersible pumping system for use downhole, wherein the system includes a pump, an inlet section for receiving fluid, a pump motor, and an actively controlled flow restriction device for controlling flow to the submersible pump from an upper fluid producing zone. Active flow control proximate to the submersible pump motor protects the pump motor from overheating.

18 Claims, 4 Drawing Sheets

DUAL ZONE FLOW CHOKE FOR DOWNHOLE MOTORS

BACKGROUND

1. Field of Invention

The present disclosure relates to downhole pumping systems submersible in well bore fluids. More specifically, the present disclosure concerns actively controlling flow to the intake of a submersible pump. Yet more specifically, the present disclosure relates to a method and apparatus for actively restricting gas flow and/or flow from a higher zone to an electrical submersible pump.

2. Description of Prior Art

Submersible pumping systems are often used in hydrocarbon producing wells for pumping fluids from within the well bore to the surface. These fluids are generally liquids and include produced liquid hydrocarbon as well as water. One type of system used in this application employs a electrical submersible pump (ESP). ESPs are typically disposed at the end of a length of production tubing and have an electrically powered motor. Often, electrical power may be supplied to the pump motor via wireline. Typically, the pumping unit is disposed within the well bore just above where perforations are made into a hydrocarbon producing zone. This placement thereby allows the produced fluids to flow past the outer surface of the pumping motor and provide a cooling effect.

With reference now to FIG. 1, an example of a submersible ESP disposed in a well bore is provided in a partial cross sectional view. In this embodiment, a downhole pumping system 12 is shown within a cased well bore 10 suspended within the well bore 10 on production tubing 34. The downhole pumping system 12 comprises a pump section 14, a seal section 18, and a motor 24. The seal section 18 forms an upper portion of the motor 24 and is used for equalizing lubricant pressure in the motor 24 with the wellbore hydrostatic pressure. Energizing the motor 24 then drives a shaft (not shown) coupled between the motor 24 and the pump section 14. Impellers are coaxially disposed on the shaft and rotate with the shaft within respective diffusers formed into the pump body 16. As is known, the centrifugal action of the impellers produces a localized reduction in pressure in the diffuser thereby inducing fluid flow into the diffuser. In this embodiment, a series of inlets 30 are provided on the pump housing wherein formation fluid can be drawn into the inlets and into the pump section 14. The source of the formation fluid, which is shown by the arrows, are perforations 26 formed through the casing 10 of the well bore and into a surrounding hydrocarbon producing formation 28. Thus the fluid flows from the formation 28, past the motor 24 on its way to the inlets 30. The flowing fluid contacts the housing of the motor 24 and draws heat from the motor 24.

In some situations submersible pumping systems are disposed in a section of a wellbore between two producing formations or zones. For example in a dewatering situation the upper zone primarily produces gas whereas the low zone produces water. Thus with reference now to FIG. 1, the upper formation 29 is shown producing a mixture of water and gas flowing through the perforations 27. The upwardly directed arrow $A_G$ represents gas flowing up the borehole 8 and the downwardly directed arrow $A_w$ represents water (or other liquids) flowing down the borehole 8. In some situations the upper formation can cause problems for the pumping system 12. For example, too much water flow from the upper formation 29 can restrict water production from the lower formation 28 thereby limiting liquid flow across the pump motor 24 and its corresponding cooling effect. Additionally, excessive gas from the upper formation can become entrained with the downflowing water and potentially cause pump cavitation. Gas from the lower formation can also make its way to the pump inlet.

SUMMARY OF INVENTION

The present disclosure includes a downhole submersible pumping system for use in a cased wellbore comprising, a pump, a motor coupled to the pump; and a variable flow regulator disposed in the annulus between the wellbore casing and the pumping system. The variable flow regulator is responsive to motor temperature, motor energy consumption, motor performance, gas flow to the pump, and combinations thereof. A control system may be included with the pumping system. A controller may be included with the control system. The controller may be connected to an indicating monitor. The indicating monitor may include a pump motor temperature indicator, a pump motor energy consumption indicator, and a gas flow meter. Optionally, the controller is configurable for controlling the variable flow regulator. The flow regulator may be a packer as well as a controllable valve. In one mode of operation, the system is disposable in a well used for dewatering operations.

The present disclosure also includes a method of operating an electrical submersible pumping system within a cased wellbore, wherein the pumping system comprises a pump, a pump motor, and a variable flow control device between the pump motor and the pump. The method comprises monitoring pumping system conditions and regulating fluid flow with the variable flow control device based on the pumping system conditions. The flow being regulated is fluid flow passing between the pumping system and the wellbore casing. The pumping system conditions include pump motor rpm, pump motor temperature, gas flow to the pump, pump motor power consumption, and combinations thereof. The steps of monitoring and regulating may be performed with a control system.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

The present disclosure provides embodiments of a downhole submersible pumping system for producing fluids from within a wellbore up to the surface. More specifically, the downhole submersible pumping system described herein includes a variable flow control device for regulating flow to the pump inlet. The variable flow control device may comprise a deformable elastomeric material, such as a packer. Optionally, a responsive control valve may be used for regulating this flow. The variable flow control device may be used in combination with a control system, wherein the control system is in communication with various operating parameters of the submersible pumping system. Those operating parameters include motor temperature, gas flow to the pump, pump energy consumption, as well as pump revolutions per minute (RPM), and pump flow rate.

Figure 1:
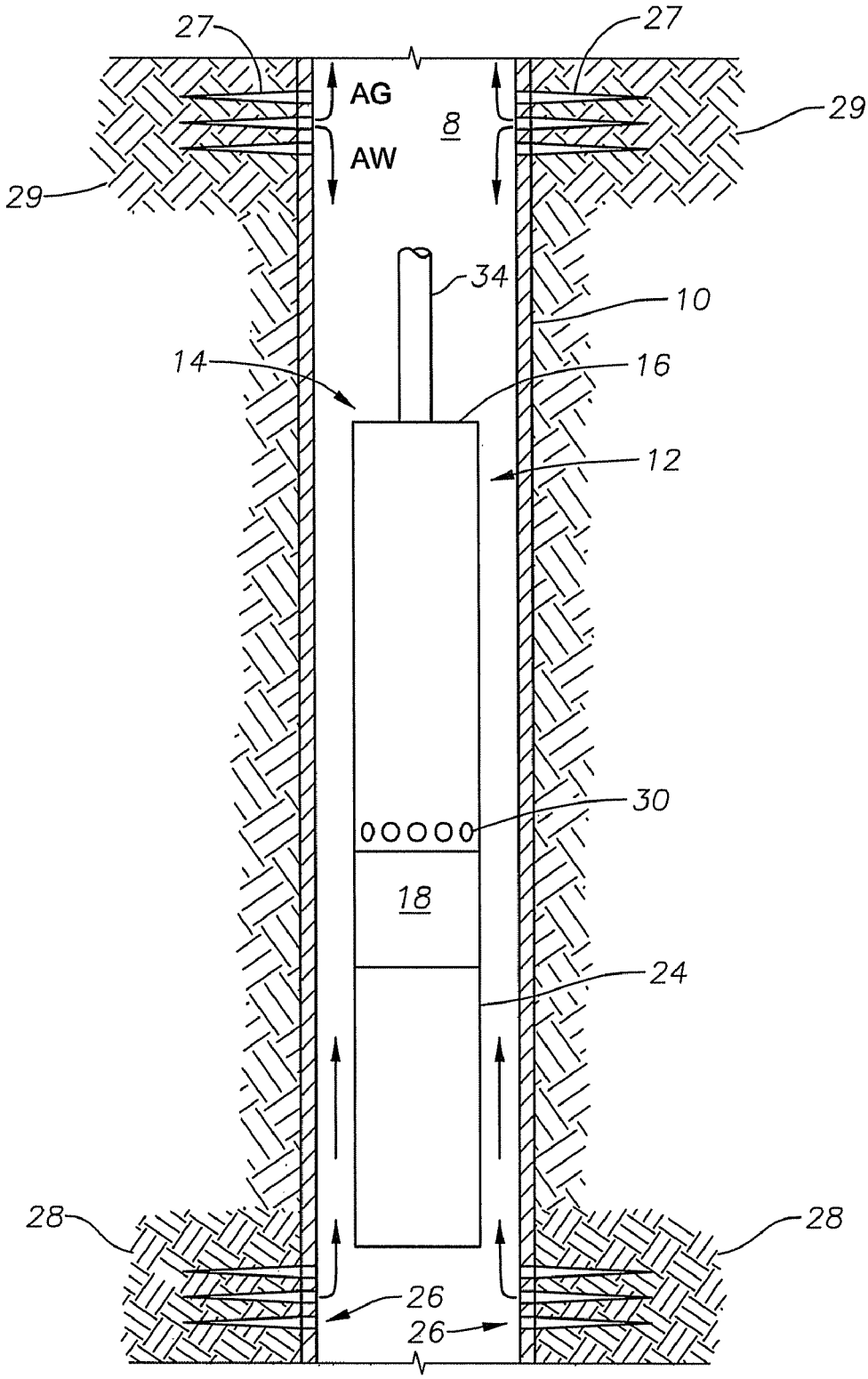
Fig. 1 (Prior Art)
FIG. 1 shows a prior art downhole submersible system shown in a partial cross sectional view.
Figure 2:
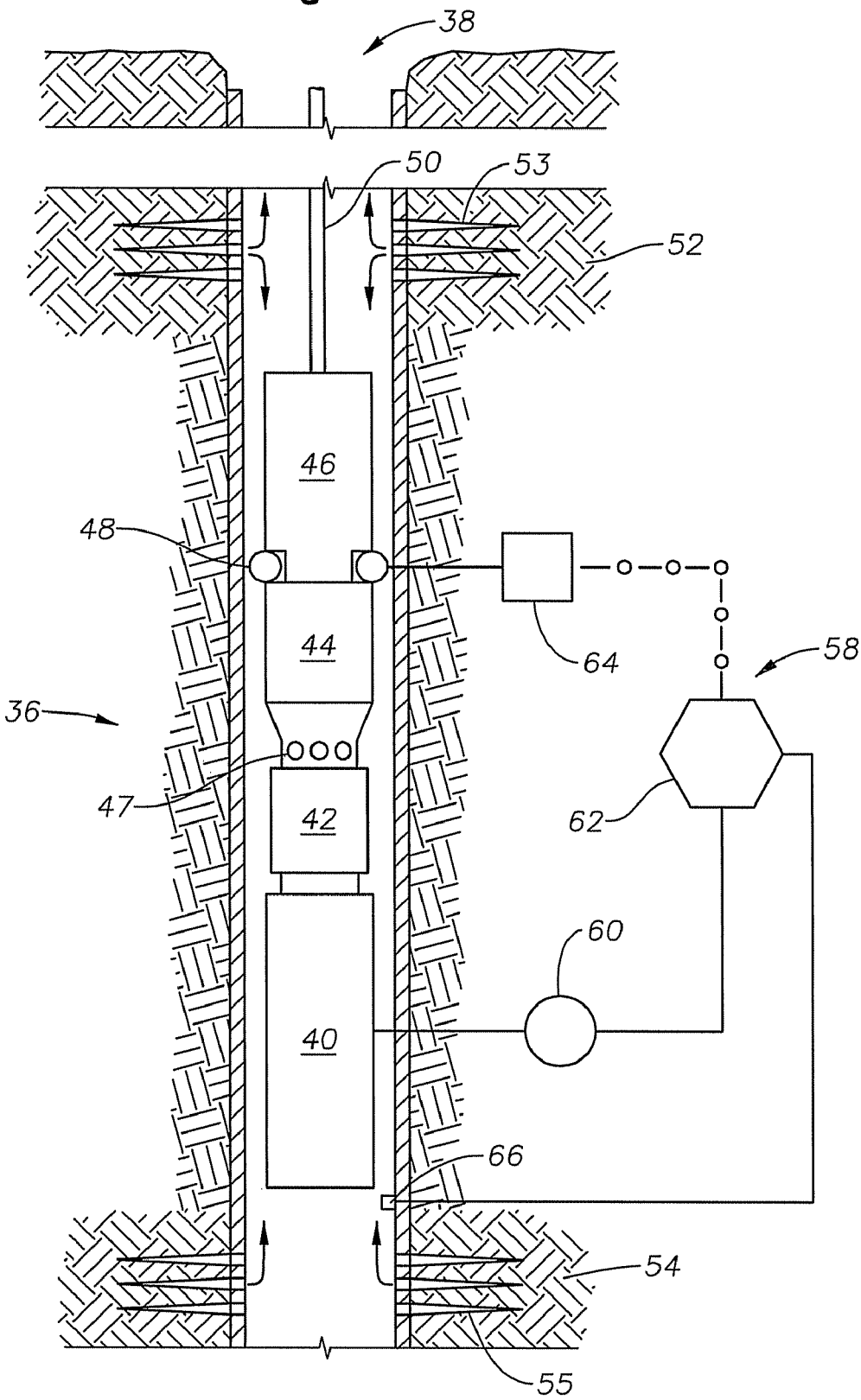
FIG. 2 shows a side view of an embodiment of a pumping system in accordance with the present disclosure disposed within a cased well bore.

FIG. 2 provides a side view of a pumping system disposed within a cased wellbore. The pumping system 36, also referred to herein as an electrical submersible pumping system, is within a cased wellbore 38 between an upper formation 52 and a lower formation 54. As will be discussed later, the upper formation 52 produces a two-phase gas/liquid combination, whereas the lower formation 54 produces primarily liquid.

The pumping system 36 comprises a motor 40, a seal section 42, an optional separator 44, and pump 46. In the embodiment of FIG. 2, inlets 47 are provided on the separator for allowing fluid to the pump 46. The inlets 47 are to be below the perforations 53 of the upper formation 52 and above the perforations 55 of the lower formation 54. The pump motor 40 as shown is an electrically powered pump mechanically coupled to the pump 46 via a shaft (not shown). The pump 40 size and capacity is dependent upon the particular application it will be used in. The seal section 42 may be included with the pumping system 36 disposed on the upper portion of the motor 40 in a coaxial fashion. The seal section 42 may be included for equalizing hydrostatic pressure of the well fluid with internal fluids within the system 36, such as the lubricant used within the motor 40.

The separator 44 is optionally included with the system 36 for removing any gas that may be entrained in the fluid flowing to the pump 46. Allowing gas to a pump inlet can lock the pump and prevent fluid flow or can damage a pump's internal components, such as its impellers. The gas separator 44 discharges into the wellbore surrounding the pump 46. The pump 46, which is coaxially disposed on the upper portion of the separator 44 can be any type of pump used for pumping wellbore fluids up an associated tubing 50 and to the wellbore surface.

Included in a recess formed on the pump outer surface is a variable flow device 48, also referred to herein as a variable flow regulator. The variable flow device 48 is configured to regulate fluid flow between the outer circumference of the pumping system and the inner circumference of the wellbore casing. The flow controller 48 is located upstream of the inlets 47, considering the direction of the fluid flow. In this embodiment, the flow controller 48 is below the inlets 47. In the embodiment of FIG. 2, the variable flow device 48 is shown in a retracted condition. However it is expandable to fully encompass the annulus existing between the pumping device 36 and the wellbore casing. By fully encompassing the annulus, any fluid flowing down adjacent the pumping system will be blocked from making its way to the lower sections of the pumping system. Optionally, the variable flow regulator's expansion can be limited to correspondingly limit fluid flow. Thus, the variable flow regular 48 can limit flow rates to a particular value or simply block the flow rate entirely.

A control system 58 shown in schematic view is provided along with the electrically submersible pumping system 36 of FIG. 2. The control system includes a monitor 60, a controller 62, and an actuator 64. The controller 62, which may comprise an information handling system (IHS) or a microprocessor, is shown in electrical communication with the monitor 60. Based upon data signals from the monitor, the controller 62 may be configured to correspondingly provide a signal to the actuator 64.

The IHS may be employed for controlling the initiating monitoring commands herein described as well as receiving the controlling the subsequent recording of the data. Moreover, the IHS may also be used to store recorded data as well as processing the data into a readable format. The IHS may be disposed at the surface, in the wellbore, or partially above and below the surface. The IHS may include a processor, memory accessible by the processor, nonvolatile storage area accessible by the processor, and logics for performing each of the steps above described.

The actuator 64 is coupled with the flow controller 48 for activating the flow controller 48 into different modes for regulating flow, i.e. fully open, fully closed, or partially closed to allow a desired flow rate between the pumping system and wellbore wall. The configuration of the actuator 64 is dependent upon embodiments of the variable flow regulator 48. For example, when the variable flow regulator 48 is an inflatable packer, the actuator can comprise a line for providing pressurized fluid to the packer to inflate the packer to an appropriate size. The pressurized fluid may comprise hydraulic as well as pneumatic fluids. In the embodiments where the packer is a compressible packer, the actuator may comprise a means for providing compression for outwardly expanding the packer. These means may be electrical as well as hydraulic or pneumatic. In the event the variable flow regulator 48 is a control valve or choke, the actuator can be a linkage system for opening and closing the valve to a certain percentage opening. In such a case, the actuator can be hydraulically as well as electrically powered.

Also optionally included is a fluid flow meter (or flow indicator) 66 for detecting fluid flow in the annulus adjacent the pump motor 40. Insufficient fluid flow across the pump motor 40 may lead to overheating. Also, as previously noted, the presence of gas within the pumping system can cause pump motor overheating. Therefore, when an excessive amount of gas is flowing towards the pump intake, it may be desirable to regulate that flow.

In one mode of operation, as previously discussed, the upper formation 52 produces a two phase flow exiting from the perforations 53 into the cased wellbore 38. As shown by the arrows, the gas typically will flow upward toward the surface, whereas the liquid, such as water, would flow downward towards the pumping system 36. In situations when too much water is flowing downward, the downward flowing water, either because of its flow rate or its hydrostatic pressure, may prevent water exiting the lower formation 54 from perforations 55 from flowing past and cooling the motor 40.

This flow of water from the lower formation is also shown by the corresponding arrows. Thus it may be necessary to restrict or hinder water flow from the upper formation 52 via the variable flow device 48. One mode of detecting excessive water flow from the upper formation 52 includes monitoring pump motor 40 temperature.

In instances where an excessive amount of gas makes its way to the pump intake, the pump might experience vapor lock resulting in lowered amperage consumed by the motor 40. Pump motor 40 overheating can also occur also by an excessive amount of gas to the pump 46. The monitor 60 therefore can be a temperature indicator. Optionally the monitor can also measure the amount of energy consumption of the pump motor 40. For the purposes of discussion herein, energy consumption includes current as well as voltage. Moreover, the monitor 60 in addition to measuring temperature and energy consumption of the motor 40 can also measure operating parameters of the pump motor 40 such as revolutions per minute (RPM).

In one mode of operation, the data recorded by either the monitor 60 or the flow meter 66 is transmittable to the controller 62. The controller 62, which can be either programmable by software or hardware, can quantify these values and determine if it is necessary to restrict flow along the length of the pumping system using the variable flow regulator 48. The controller 62 is programmable to read these values from the monitor 60 and/or flow meter 66 then appropriate provide controlling commands to the actuator 64 for actuating the variable flow control device 48. When the amount of gas flowing into the pump 46 is not excessive, the flow controller 48 may be opened fully to allow full liquid flow down the casing.

The controller 62 can be included with the electrical pumping system 36 and disposed totally downhole. Optionally, the controller 62 can be situated at surface wherein commands to and from the electrically submersible pumping system 36 can be via a hardwire line downhole or telemetry. Also optionally, commands to the controller 62 can either be made solely from a surface operator, or in conjunction with stored software commands stored within the controller 62 for another type of system control device.

Figure 3:
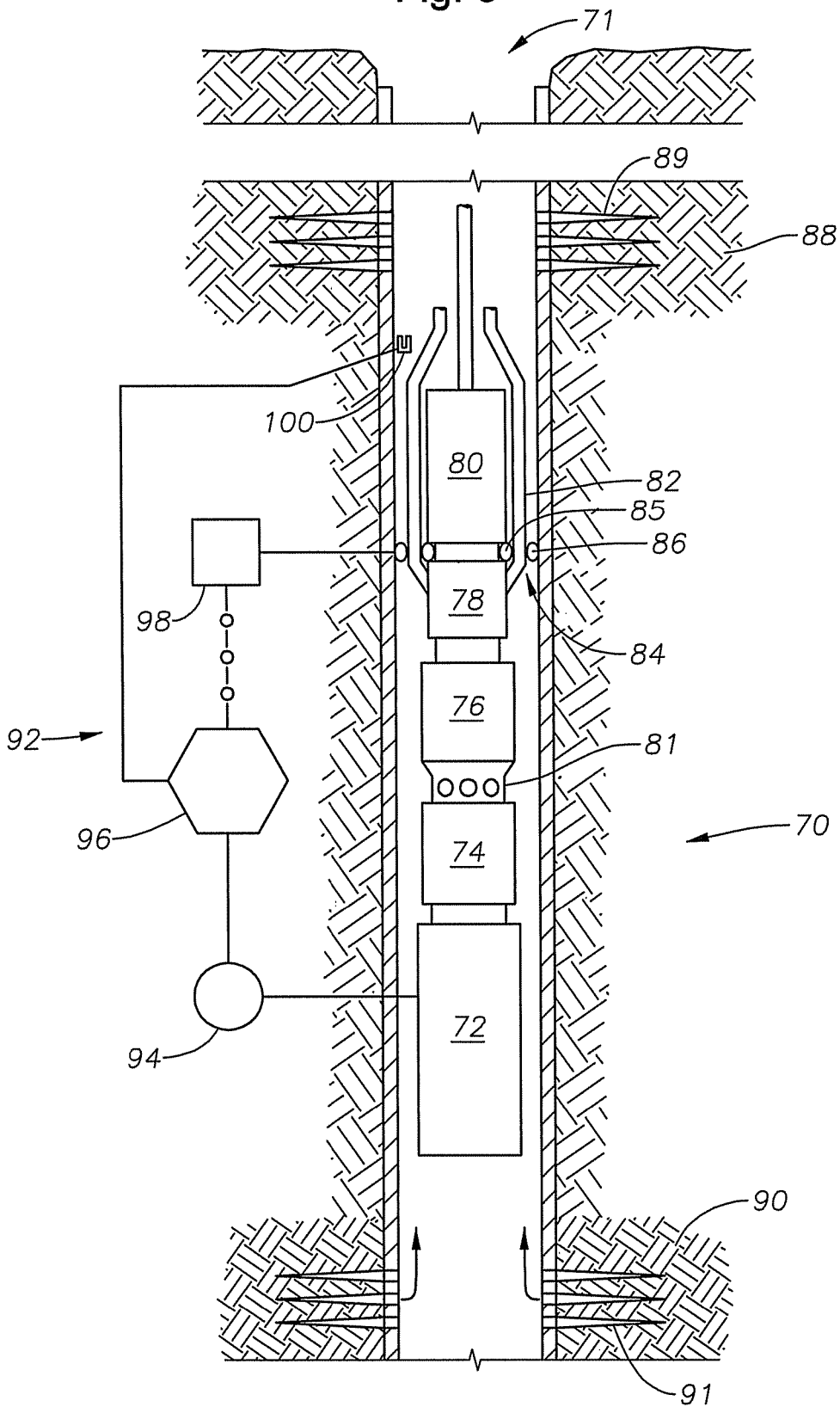
FIG. 3 shows a side view of another embodiment of a pumping system in accordance with the present disclosure disposed within a cased well bore.

With reference now to FIG. 3, which is another embodiment of a downhole submersible electrical pumping system 70 (ESP), is shown in a side view, where this pumping system 70 is disposed within a cased wellbore 71. In this embodiment, the ESP 70 comprises a motor 72 having a coaxially formed seal section 74 disposed on the upper portion of the motor 72. Also included in this embodiment is a charge pump 76, a gas separator 78 and a corresponding pump 80. The charge pump can handle gas better than the primary lift pump and increases pressure such that a gas separator would displace higher pressure gas out the discharge tubes.

Stand pipes 82 are included with this embodiment of FIG. 3 and are shown exiting the separator 78 and extending upward into the wellbore. In this embodiment, the gas received by the pumping system is separated from the total fluid intake and inserted in the stand pipes for delivery uphole in the casing annulus surrounding the tubing. Due to the presence of the standpipes 82, a modified variable flow device 84 is provided. This embodiment of FIG. 3 therefore uses a dual variable flow controller 84 having an inner portion 85 and an outer portion 86. As shown the pump intake 81 is disposed below the flow controller 84.

Similar to the embodiment of FIG. 2, the downhole pumping system 70 of FIG. 3 includes a control system 92 for monitoring downhole conditions and providing flow control commands to the flow controller 84. The control system 92 comprises a monitor 94 in communication with the motor 72 and configured for monitoring motor temperature, motor RPM, and motor energy consumption. The monitor 94 is in communication with the controller 96. Although communication is shown with an electrical connection, the communication can be via software, telemetry, pneumatic, or any other known way of transmitting data from one device to another.

Also included is a flow meter 100 in communication with the controller 96. As with the monitor, the communication between the flow meter and the controller can be of any known manner. The embodiment of FIG. 3 further includes the actuator 98 that operates based upon dependent commands from the controller 96. In this embodiment, the actuator 98 can actuate one of the inner portion 85 or the outer portion 86 independent of one another. Thus, flow control could be by actuating one of these portions as well as both of the portions simultaneously. As shown, the standpipes extend through the flow controller 84 thus flow controller 84 may expand into the region azimuthially disposed between adjacent standpipes 82.

In the ESP 70 of FIG. 3, it is disposed also between a upper formation 88 and a lower formation 90, wherein the upper formation produces a two phase flow from corresponding perforations 89. The two phase flow, being a gas and a liquid, is illustrated by the arrows extending from the perforations into the wellbore 71. Similarly, the lower formation 90 produces primarily water from its perforations 91 extending from the formation into the cased wellbore. Arrows within the wellbore illustrate water flow from the lower formation 90 up towards the electrically submersible pumping system 70.

Figure 6:
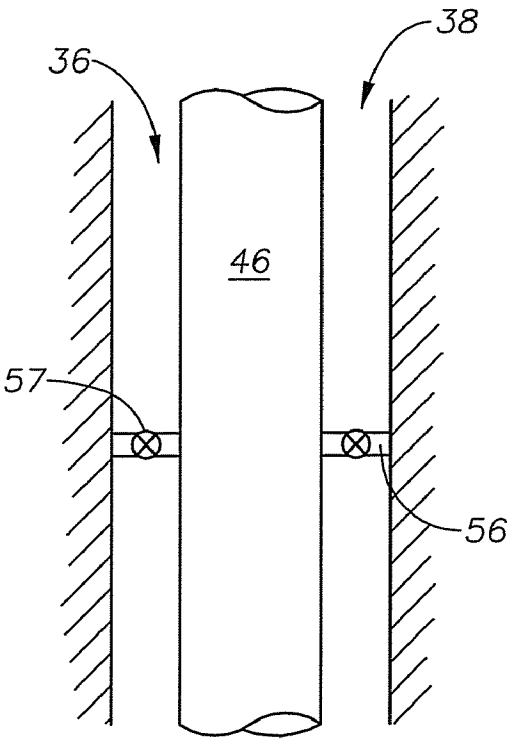
FIG. 6 illustrates a side view of variable flow device embodiments.
Figure 5:
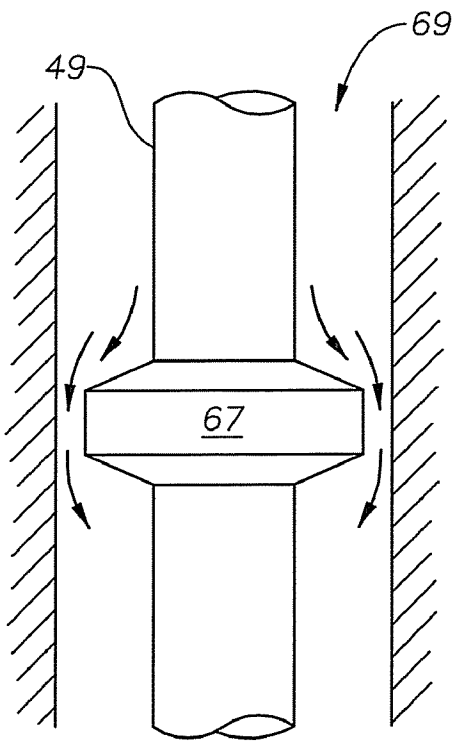
FIG. 5 illustrates a side view of variable flow device embodiments.
Figure 4:
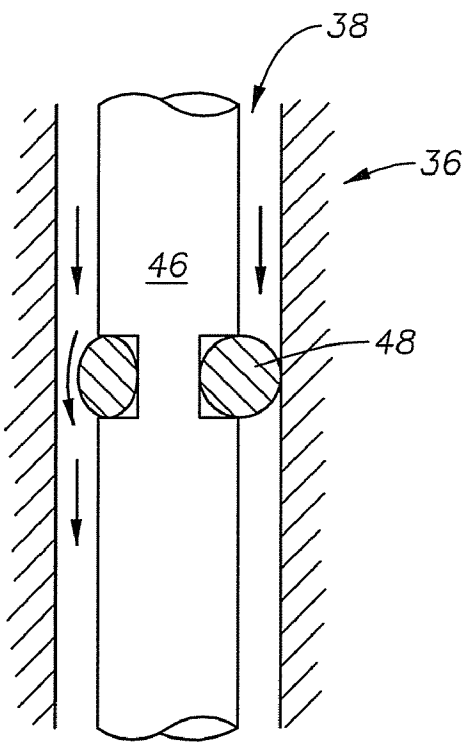
FIG. 4 illustrates a side view of variable flow device embodiments.

FIGS. 4 through 6 provide a side and cross sectional view of alternative embodiments of a variable flow regulator. FIG. 4 shows in side view an embodiment of a portion of an electrical submersible pumping system 36 disposed within a cased wellbore 38. In this embodiment, the variable flow regulator 48 is an expandable packer disposed along the outer portion of the pump section 46 of the pumping system 36. As shown in FIG. 4, the variable flow regulator 48 has been expanded for restricting flow through the wellbore 38. Fluid flow, shown as arrows, can be seen blocked in one portion of the wellbore. In another portion, the flow is restricted to a small annular portion between the pumping system and the cased wellbore. In this example therefore, it is illustrated how the variable control device can either totally block the flow along the pumping system or may restrict it to some portion of the possible total flow by blocking only a portion of the annular region between the pumping system and the cased wellbore.

Another embodiment of the variable flow regulator 69 is shown in side view in FIG. 5. In this embodiment, the variable flow regulator 69 comprises a compressible packer 67 and is in the compressed state thereby expanding outward to restrict the annular region and impede fluid flow between the pumping system and the cased wellbore. A sleeve 49 is provided in this embodiment shown urged downward against the packer for pressing the packer and causing it to expand outward. The sleeve 49 may be powered either from an electrical motor as well as hydraulically actuated.

FIG. 6 provides yet another embodiment of the variable flow regulator. In this embodiment, the variable flow regulator comprises an annular barrier 56 that fully blocks the annular region between the pumping system 36 and the wellbore 38. The annular plug 56 circumscribes the pumping system 36 proximate to the outer housing of the pump. A control valve 57 is provided in an opening axially formed through the annular barrier 56. While the embodiment of FIG. 6 illustrates two control valves 57, a single control valve can be used in this embodiment as well as more than two. The control valve 57 may be actuatable by the actuator such as the one shown in FIG. 2 and be put in either a fully open position, a fully closed position, or an intermediate position for regulating the amount of flow passing within this annular region.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The invention claimed is:

1. A downhole submersible pumping system disposable in a conduit comprising:

an electrical submersible pump assembly having a rotary pump driven by a motor; and;

a variable flow regulator disposed around the pump assembly, the flow regulator comprising a packer element having a circumference that is radially expansible, the flow regulator being positioned in the conduit to restrict fluid flow in the conduit past the circumference to an intake of the pump;

an actuator cooperatively engaged with the packer element for selectively moving the packer element into a fully open position allowing a maximum fluid flow rate past the circumference to the intake, a partially closed position restricting fluid flow past the circumference to the intake to a fluid flow rate less than the maximum fluid flow rate;

a sensor that senses at least one operating condition of the pumping system; and a control system that receives signals from the sensor and controls the actuator in response to the operating condition sensed to move the packer element between the fully open position and the partially closed position while the motor and pump are operating.

2. The pumping system of claim 1, wherein the operating condition of the pumping system is selected from the list consisting of motor temperature, motor energy consumption, motor performance, gas flow to the pump, and fluid flow rate proximate to the motor.

3. The pumping system of claim 1, wherein the actuator also selectively moves the packer element to a fully closed position while the pump and motor are operating, with the circumference of the packer element engaging the conduit and blocking all fluid flow past the packer element to the intake of the pump.

4. The pumping system of claim 3, wherein:

the packer element is inflatable; and the actuator comprises a conduit connected with the packer element that delivers inflating fluid to the packer element.

5. The pumping system of claim 1, wherein the motor is located below pump and the packer element is located above an intake of the pump.

6. The pumping system of claim 1, wherein the sensor comprises a flow meter that measures a fluid flow rate past the motor to the intake of the pump.

7. The pumping system of claim 1, wherein the packer element is located above the intake of the pump.

8. The pumping system of claim 1, further comprising a gas separator and a stand pipe extending from the gas separator, wherein the variable flow regulator is formed to accommodate the passage of the standpipe therethrough.

9. An electrical submersible pumping system disposed in a cased wellbore comprising:

a pump in the wellbore having an intake;

a pump motor operatively coupled to and below the pump;

a packer element disposed on the outer surface of the pumping system, the packer element having a circumference that is radially expansible;

an actuator cooperatively engaged with the sacker element to selectively move the circumference closer and farther from the cased wellbore, defining a variable flow area between the cased wellbore and the circumference of the packer element;

a motor sensor that senses an operating condition of the motor; and a control system in operable communication with the actuator and the sensor, the control system causing the actuator to move the circumference of the packer element to vary the flow area in response to the operating condition sensed by the sensor while the motor is operating.

10. The electrical submersible pumping system of claim 9, further comprising:

a pump sensor that senses a pumping system condition;

wherein the control system also causes the actuator to vary the flow area in response to the pumping system condition; and the pumping system condition is selected from the list consisting of pump flow rate, pump rpm, pump motor energy consumption, pump motor temperature, and gas flow to the pump.

11. The electrical submersible pumping system of claim 9, wherein;

the motor is located below the pump and above a lower set of perforations in the cased wellbore;

the intake of the pump is in fluid communication with the lower set of perforations and located below and in fluid communication with an upper set of perforations; and the packer element is located above the intake of the rump and below the upper set of perforations.

12. The electrical submersible pumping system of claim 9 wherein the packer element is inflatable to vary the circumference.

13. The electrical submersible pumping system of claim 9, wherein the variable flow regulator comprises a compressible packer element having a variable circumference.

14. A method of operating an electrical submersible pumping system within a conduit, wherein the pumping system comprises a pump and a pump motor, said method comprising:

(a) providing a variable flow control device around the pumping system in a flow path to an intake of the pump, the variable flow control device comprising a packer element having a circumference that is radially expansible, the variable flow control device having an actuator that selectively actuates the variable flow control device to vary a flow area between the circumference of the packer element and the conduit;

(b) monitoring a pumping system conditions condition; and (c) while the pump and pump motor are operating, controlling the actuator to change the flow area based on the pumping system conditions monitored in step (b).

15. The method of claim 14 wherein step (b) comprises monitoring a condition selected from the list consisting of pump motor rpm, pump motor temperature, gas flow to the pump, and pump motor power consumption.

16. The method of claim 14 wherein step (b) comprises measuring a fluid flow rate past the motor to the intake of the pump.

17. The method of claim 14, wherein:

the conduit comprises a cased wellbore with a lower and an upper set of perforations;

the motor is located below the pump and above the lower set of perforations;

the intake of the pump is in fluid communication with the lower set of perforations and located below and in fluid communication with the upper set of perforations; and the packer element is located above the intake of the pump and below the upper set of perforations.

18. The method of claim 14, wherein step (c) comprises selectively changing the circumference between a fully open position, with a maximum flow area between the conduit and the circumference to a partially closed position with a lesser flow area between the circumference and the conduit, and a closed position with the circumference engaging the conduit.

* * * * *